US007734222B2

(12) United States Patent
Hatakeyama et al.

(10) Patent No.: US 7,734,222 B2
(45) **Date of Patent: *Jun. 8, 2010**

(54) IMAGE FORMING APPARATUS WITH FLEXIBLE TUBE FOR COOLING AIR AND GUIDE CHANNEL FOR FLEXIBLE TUBE

(75) Inventors: Chisato Hatakeyama, Osaka (JP); Masami Ikeda, Osaka (JP); Yasuyuki Fukunaga, Osaka (JP); Keiichi Funaki, Osaka (JP)

(73) Assignee: Kyocera Mita Corporation (JP)

( * ) Notice: Subject to any disclaimer, the term of this patent is extended or adjusted under 35 U.S.C. 154(b) by 939 days.

This patent is subject to a terminal disclaimer.

(21) Appl. No.: 11/473,292

(22) Filed: Jun. 22, 2006

(65) Prior Publication Data

US 2007/0003313 A1 Jan. 4, 2007

(30) Foreign Application Priority Data

Jun. 30, 2005 (JP) ..... 2005-191900

(51) Int. Cl.
*G03G 21/20* (2006.01)

(52) U.S. Cl. ..... 399/175

(58) Field of Classification Search ..... 399/91–93, 399/343, 355
See application file for complete search history.

(56) References Cited

U.S. PATENT DOCUMENTS 6,785,490 B2 * 8/2004 Tsukamoto et al. ..... 399/94

FOREIGN PATENT DOCUMENTS

JP 2002-6697 1/2002

OTHER PUBLICATIONS

JP 2002-062702 A; machine translation.*
JP 2000-305344 A; machine translation.*

* cited by examiner

*Primary Examiner*—David M Gray
*Assistant Examiner*—Ruth N Labombard
(74) *Attorney, Agent, or Firm*—Gerald E. Hespos; Michael J. Porco

(57) ABSTRACT

An image forming apparatus is provided with a cooling fan for cooling toner boxes within the apparatus. The outlet of the cooling fan and the toner boxes are connected by flexible tubes, respectively. This makes it possible to connect the cooling fan with the toner boxes even if there is not sufficient space, thereby enabling cooling of the toner boxes.

16 Claims, 6 Drawing Sheets

IMAGE FORMING APPARATUS WITH FLEXIBLE TUBE FOR COOLING AIR AND GUIDE CHANNEL FOR FLEXIBLE TUBE

BACKGROUND OF THE INVENTION

1. Field of the Invention

This invention relates to an image forming apparatus having a housing capable of cooling an object inside the housing by means of a cooling fan.

2. Description of the Related Art

In this field of art, there have been known various image forming apparatus, such as printers, copying machines, facsimiles, or multi-functional products in combination thereof, in which objects of a nature to generate heat are cooled by means of a cooling fan.

For example, a full color image forming apparatus includes a toner box for containing a black toner, a toner box for containing a cyan toner, a toner box for containing a yellow toner and a toner box for containing a magenta toner. Each of these four toner boxes generates heat upon toner stirring therein at the stirring blade or the bearing for the stirring shaft. Thus generated heat would damage the toner to lose its fluidity, which results in a failure in forming a desired color image.

For solving the above problem, Japanese Unexamined Patent Publication No. 2002-6697, for example, has proposed to introduce air taken-in by the cooling fan to each of the four toner boxes with corresponding number of air ducts to cool the boxes, respectively.

The above prior art, however, remains with a problem unsolved in that the toner boxes cannot be cooled if there is no space to provide the four ducts between the air exit of the cooling fan and each of the toner boxes.

SUMMARY OF THE INVENTION

An object of the present invention is to provide an image forming apparatus which is free from the above mentioned problems.

Another object of the present invention is to provide an image forming apparatus which enables cooling of an object to be cooled even if there is no space to provide a duct or the like between an outlet of a cooling fan and the object.

To achieve the above objects, according to an aspect of the invention, an image forming apparatus is provided with an air introducing member made of a flexible material for introducing air taken-in from the outside of a housing of the apparatus to a portion to be cooled.

Thus constructed image forming apparatus makes it possible to successfully cool the object to be cooled even if there is no space to provide a duct or the like between an air current generator and the object.

These and other objects, features, aspects, and advantages of the present invention will become more apparent from the following detailed description along with the accompanying drawings.

DETAILED DESCRIPTION OF THE PREFERRED EMBODIMENTS

A preferred embodiment of the invention will be below described with reference to the drawings.

Figure 1:
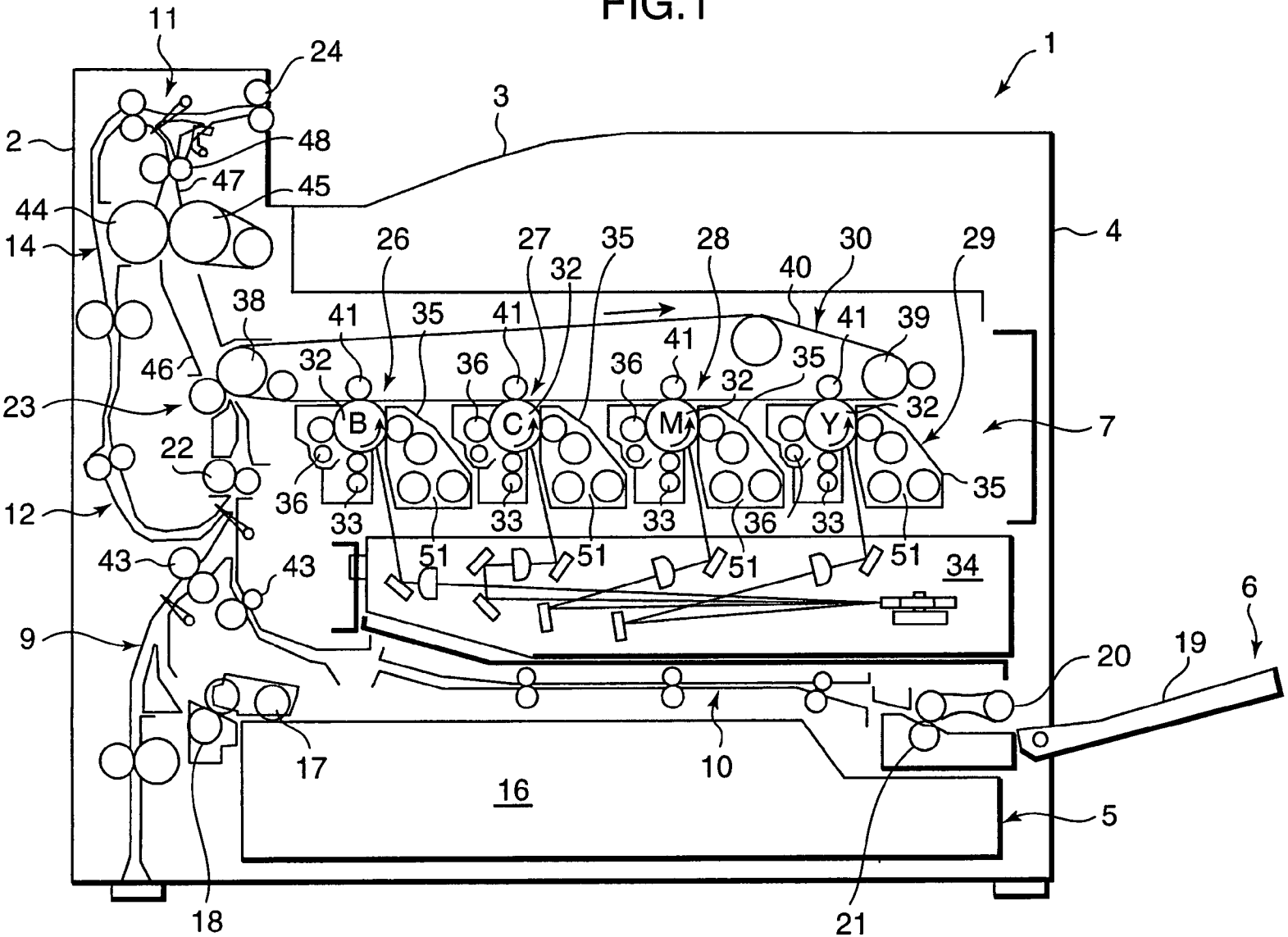
FIG. 1 is a schematic side sectional view of an image forming apparatus according to an embodiment of the invention.

FIG. 1 is a diagram schematically showing an internal construction of an image forming apparatus 1 according to an embodiment of the invention. The image forming apparatus 1 is a tandem type of color printer, and includes a housing 2 in the shape of a rectangular box. The housing 2 is formed on a top thereof with a sheet discharge section 3 (discharge tray) to which a sheet formed with a color image is discharged.

In the housing 2: in a lower part is provided a sheet cassette 5 for storing sheets; in an intermediate part is provided a stack tray 6 for feeding a sheet manually; and in an upper part is provided an image forming section 7 for forming an image on a sheet in accordance with image data of letters and pictures transmitted externally. A first conveyance passage 9 is provided in a left side part of the housing 4 to convey a sheet picked up from the sheet cassette 5 to the image forming section 7. A second conveyance passage 10 extends from a right side to a left side to convey a sheet from the stack tray 6 to the image forming section 7. In a left upper part of the housing 4, there are provided a fixing unit 14 to execute fixing operation to the sheet on which an image has been formed in the image forming section 7, and a third conveyance passage 11 to convey the sheet on which the fixing operation has been executed to the sheet discharge section 3.

The sheet cassette 5 is operable to be withdrawn outwards (frontward in FIG. 1) from the housing 4 to replenish sheets therein. The sheet cassette 5 has a storage chamber capable of selectively storing at least two kinds of sheets having different sizes with respect to a sheet feeding direction. The sheets stored in the sheet storage chamber 16 are picked up and conveyed to the first conveyance passage 9 one after another by a sheet feeding roller 17 and a separating roller 18.

The stack tray 6 has a sheet receptacle member 19 which is externally provided on a right side of the housing 4 to support sheets for manual feeding. The sheets stacked on the sheet receptacle member 19 are picked up and conveyed to the second conveyance passage 10 one after another by a pickup roller 20 and a separating roller 21.

The first conveyance passage 9 and the second conveyance passage 10 join together before a pair of registration rollers 22. A full color toner image formed on a first transfer belt, which is to be described later, is transferred to the sheet by a second transferring roller 23, and fixed by the fixing unit 14, and is discharged to the sheet discharge section 3 by a pair of discharging rollers 9. According to need, the sheet is reversed in a fourth conveyance passage 12, and thereafter a full color toner image is transferred onto the opposite surface of the sheet by the second transferring roller 23 and is fixed in the fixing unit 14.

The image forming section 7 has a first image forming unit 26 which forms a black (B) toner image, a second image forming unit 27 which forms a cyan (C) toner image, a third image forming unit 28 which forms a magenta (M) toner image, a fourth image forming unit 29 which forms a yellow (Y) image, and an image transfer and carrier mechanism 30 for carrying images which are formed respectively by the image forming units 26 to 29 and are to be transferred onto a sheet.

Each of the image forming units 26 to 29 has a photoconductive drum 32, a charging portion 33 which is provided so as to face a peripheral surface of the photoconductive drum 32, a developing portion 35 which is provided so as to face the peripheral surface of the photoconductive drum 32 at a downstream of the position where a laser beam from a laser scanning unit 34 is irradiated, and a cleaning portion 36 which is provided so as to face the peripheral surface of the photoconductive drum 32 at a downstream of the developing portion 35. The laser scanning unit 34 irradiates a laser beam to a predetermined portion of the peripheral surface of photoconductive drum 32 at a downstream of the charging portion 33.

The respective photoconductive drums 32 of the image forming units 26 to 29 are rotated in a counter-clockwise direction as shown in FIG. 1 by an unillustrated driving motor. Furthermore, the four developing sections 35 of the image forming units 26 to 29 have toner boxes 51 which contain black toner, cyan toner, magenta toner, and yellow toner, respectively.

The image transfer and carrier mechanism 30 has a posterior roller (driving roller) 38 which is provided near the first image forming unit 26, an anterior roller (driven roller) 39 which is provided near the fourth image forming unit 29, a first transfer belt 40 which runs around the posterior roller 38 and the anterior roller 39, and four transferring rollers 41. Each of the four transferring rollers 41 is provided so as to press the first transfer belt onto the photoconductive drum 32 at a downstream of the developing section 35 in each of the respective image forming units 26 to 29.

In the image transfer and carrier mechanism 30, different color toner images are sequentially transferred onto the first transfer belt at the respective transferring rollers 41 of the image forming units 26 to 29 to thereby form a full color image.

The first conveyance passage 9 is adapted to convey a sheet picked up from the sheet cassette 5 to the image transfer and carrier mechanism 30, and has a plurality of pairs of conveying rollers 43 provided at predetermined positions and the pair of registration rollers 22 which are provided before the image transfer and carrier mechanism 30. The pair of registration rollers 22 are adapted to place the image forming operation of the image forming section 7 and the sheet feeding in timed with each other.

The fixing unit 14 is adapted to execute fixing operation by heating the sheet on which a toner image has been transferred in the image forming section 7, and has a fixing roller 44 which is heated by an internally mounted heater, a pressing roller 45 which is mounted so as to press the fixing roller 44, an anterior conveyance passage 46 and a posterior conveyance passage 47. The anterior conveyance passage 46 is located before the fixing roller 44 and the pressing roller 45 and is adapted to guide a sheet conveyed by the first conveyance section 9 to a position between the fixing roller 44 and the pressing roller 45. The posterior conveyance passage 47 is located after the fixing roller 44 and the pressing roller 45, and is adapted to guide to the third conveyance passage 11 the sheet which has passed through the fixing roller 44 and the pressing roller 45.

The third conveyance passage 11 is adapted to convey the sheet on which the fixing operation has been executed by the fixing unit 14 to the sheet discharge section 3, and has a conveyance roller pair 48 at its predetermined position and a discharging roller pair 24 at an outlet.

Further, the respective toner boxes 51 in the developing sections 35 of the image forming units 26 to 29 contain toner particles of black, cyan, magenta, and yellow, respectively. In each of the toner boxes 51, toner is stirred, which results in heat generation at the stirring blade or the bearing for the stirring shaft. Thus generated heat would damage the toner to lose its fluidity, which results in a failure in forming a desired color image.

FIGS. 2 to 6A and 6B show a manner of cooling the four toner boxes 51, which correspond to an object to be cooled, by means of a single cooling fan 52.

Figure 2:
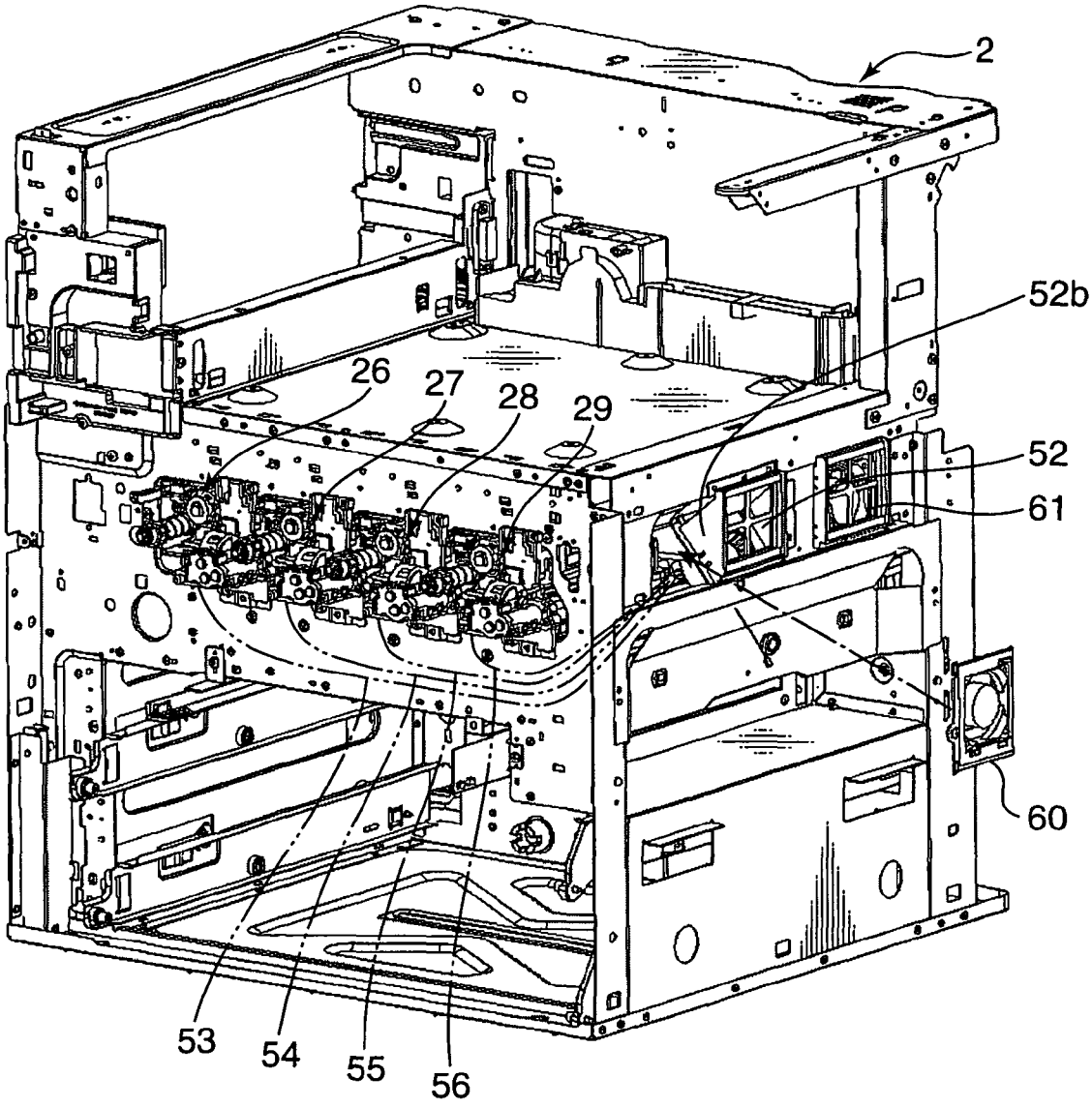
FIG. 2 is a perspective view showing a positional relationship between image forming units and a cooling fan provided in the image forming apparatus.
Figure 3:
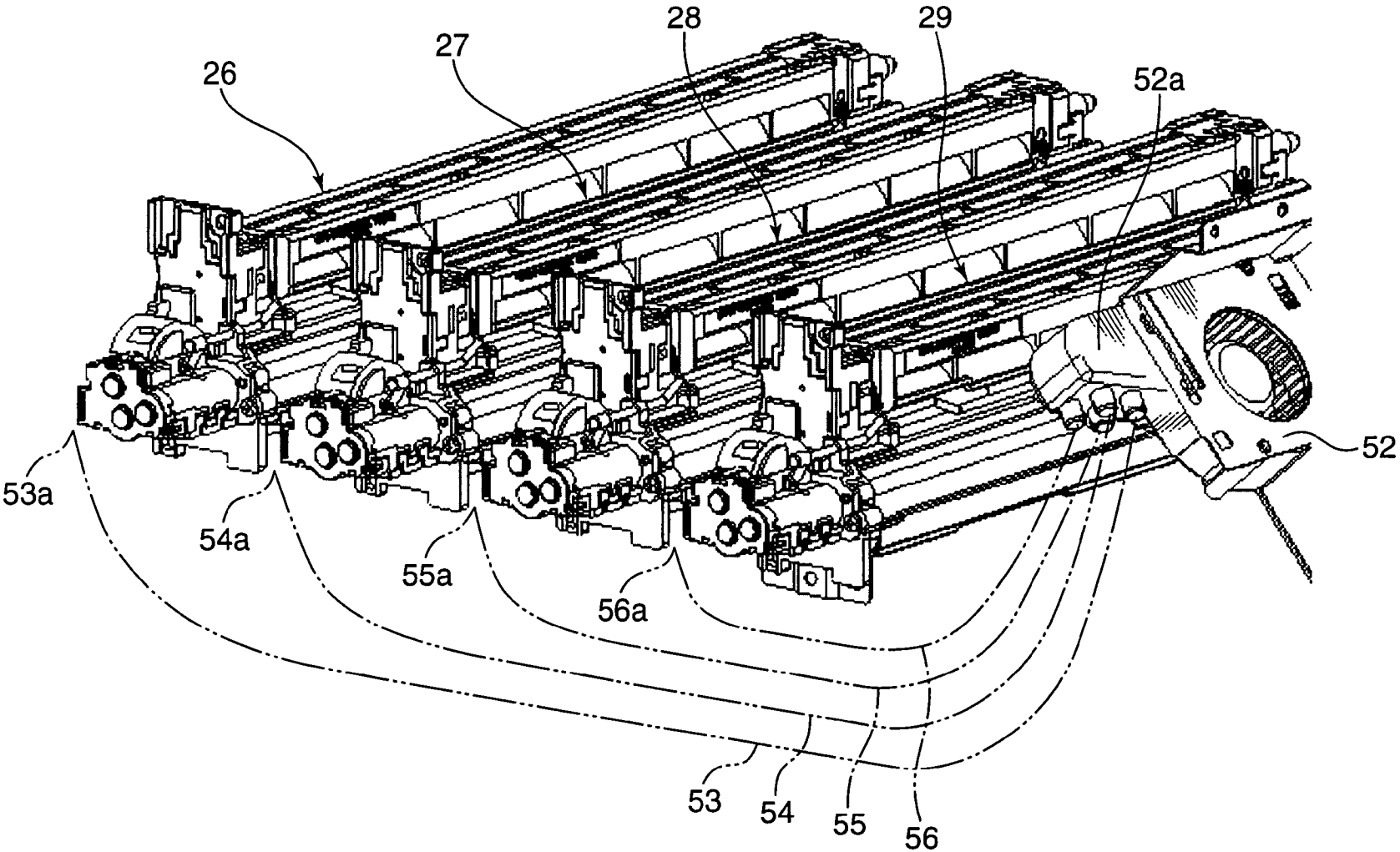
FIG. 3 is a perspective view showing the positional relationship between the image forming units and the cooling fan, and a connection of them by flexible tubes.

As shown in FIG. 2, in the housing 2, the right side of which is provided with the cooling fan 52 (e.g., sirocco fan). The cooling fan 52 is attached to the housing by way of an attachment member 52*b* having an air taking-in window. As shown in FIG. 3, tailing ends of four flexible tubes 53 to 56 are combinedly inserted into an air exit 52*a* of the cooling fan 52. The right side of the housing 2 is further provided with another cooling fans 60 and 61. However, the air currents generated by these fans 60 and 61 are led by conventional air ducts to other objects to be cooled.

Figure 4:
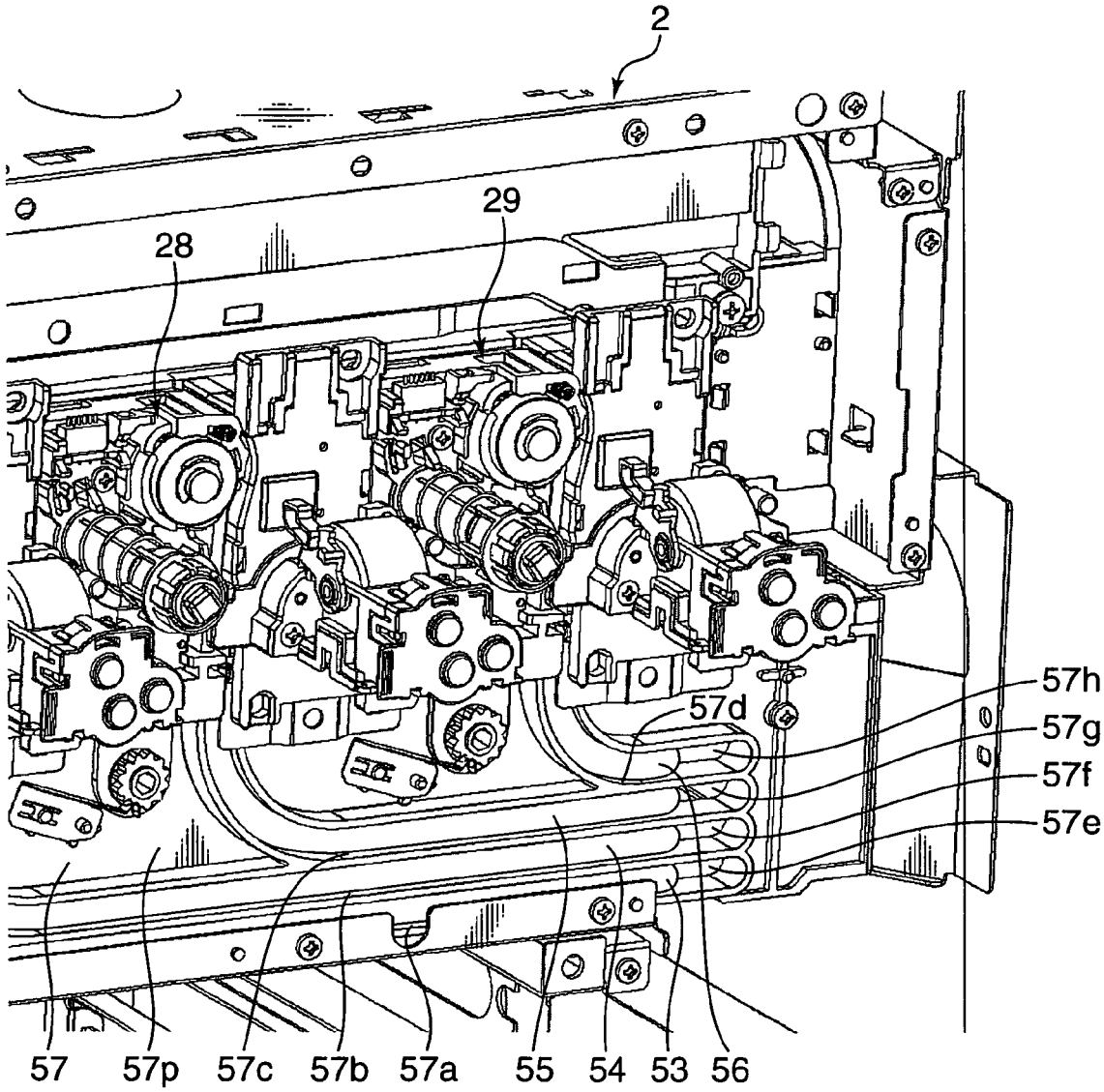
FIG. 4 is a perspective view showing a main portion of the image forming apparatus.
Figure 5:
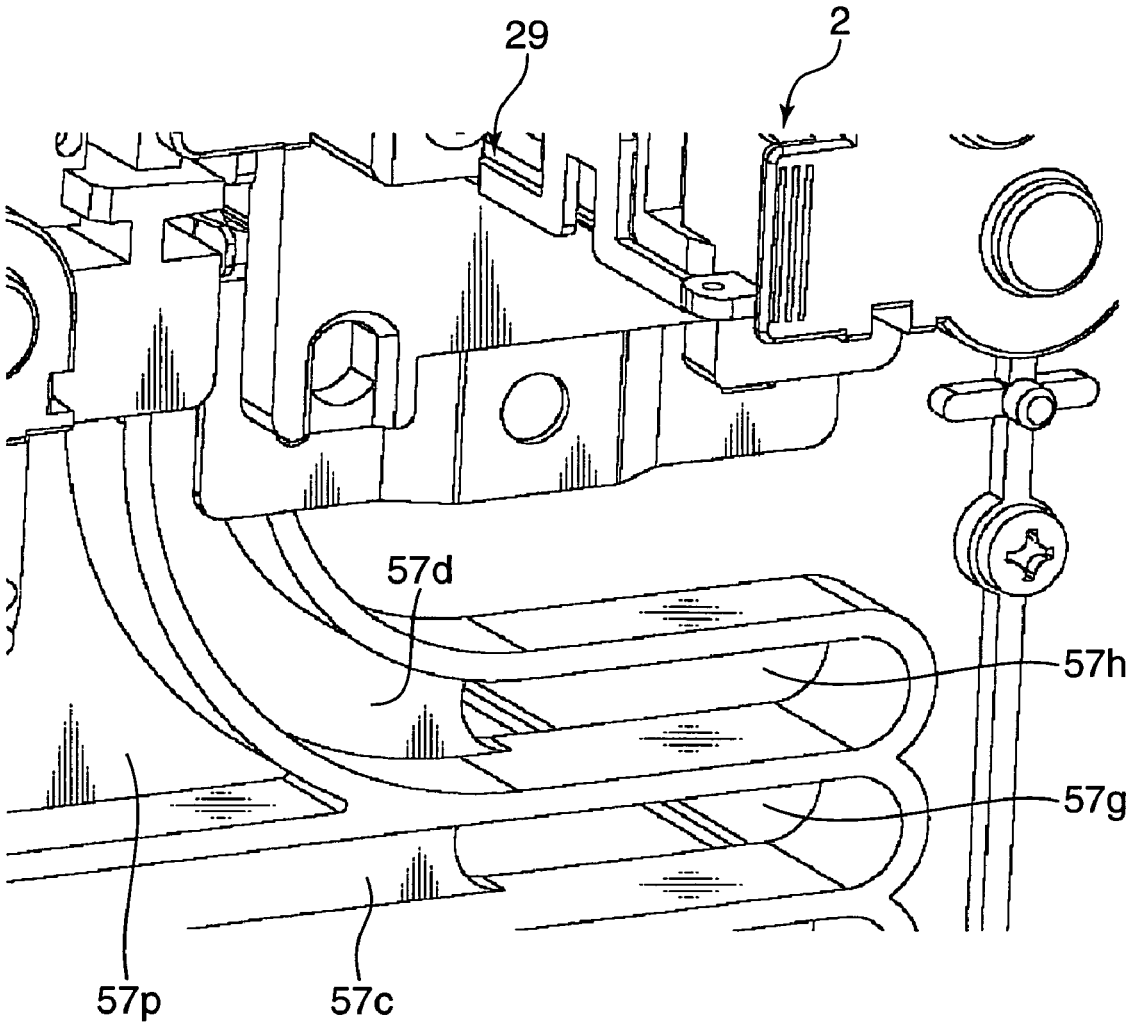
FIG. 5 is a perspective view showing channels formed on a side frame.
Figure 6A:
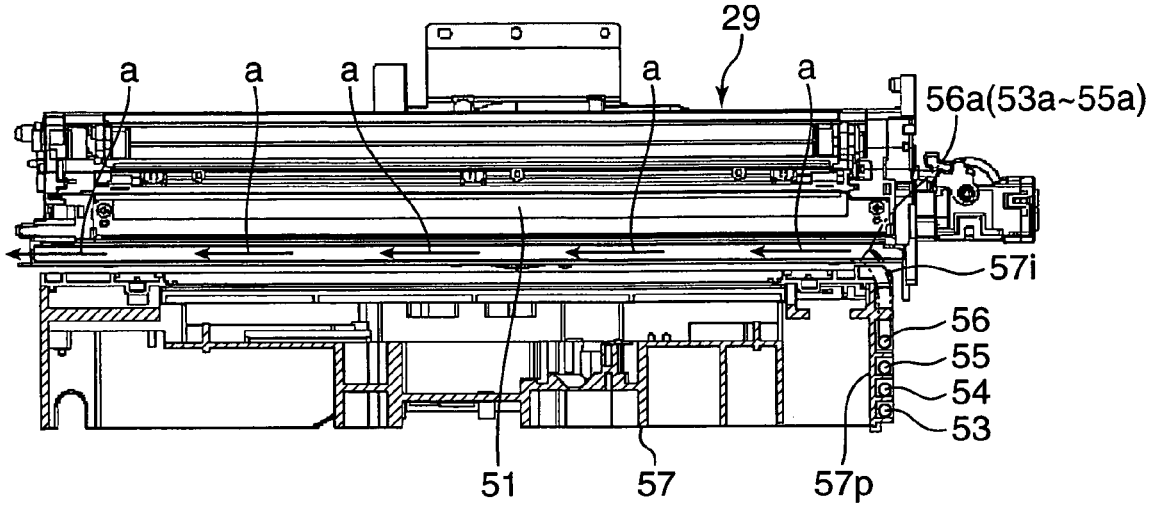
FIG. 6A is a front view showing a positional relationship between a toner box of the image forming unit and an air blowing leading end of the flexible tube.
Figure 6B:
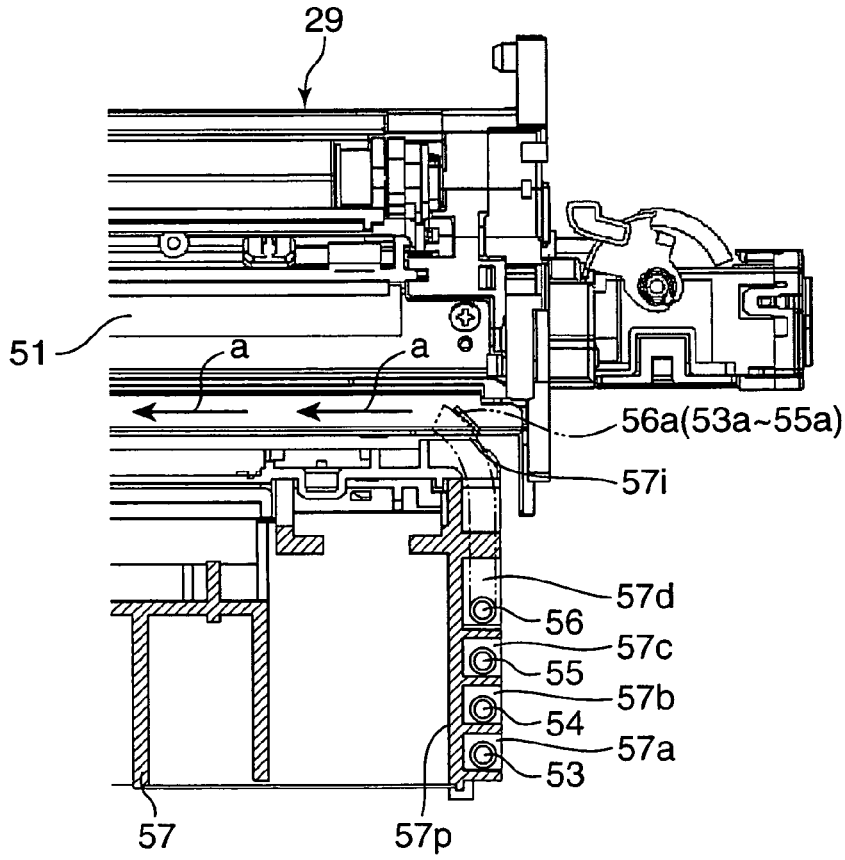
FIG. 6B is an enlarged front view showing a main portion of the arrangement shown in FIG. 6A.

As shown in FIG. 4 or FIG. 6A or FIG. 6B, that is a partial enlargement of FIG. 6A, the front part of the housing 2 is provided with a main frame 57 having a side frame wall 57*p*, which is located beneath the toner boxes 51. The front surface of the side frame wall 57*p* is provided with four tiers of channels 57*a* to 57*d* into which the flexible tubes 53 to 56 are fitted, respectively. The channels 57*a* to 57*d* each horizontally extend to guide the flexible tubes 53 to 56. Alternatively, the channels 57*a* to 57*d* may be formed at any desired portion other than the side frame wall 57*p* of the main frame 57. For example, the channels 57*a* to 57*d* may be formed on a side frame wall of the frame for the laser scanning unit 34. The flexible tubes 53 to 56 each originated in the right side portion of the housing 2, at which the cooling fan 52 is located, are drawn out of holes 57*e* to 57*h* bored through the side frame wall 57*p* to fit along the channels 57*a* to 57*d*, respectively.

The uppermost channel 57*d* leads toward the vicinity of the lower part of the toner box 51 of the fourth image forming unit 29 which forms a yellow (Y) image, the next channel 57*c* toward the vicinity of the lower part of the toner box 51 of the third image forming unit 28 which forms a magenta (M) image, the further next channel 57*b* toward the vicinity of the lower part of the toner box 51 of the second image forming unit 27 which forms a cyan (C) image, and the lowermost channel 57*a* toward the vicinity of the lower part of the toner box 51 of the first image forming unit 29 which forms a black (B) image, respectively.

As shown in FIG. 6A or FIG. 6B the enlargement thereof, the channels 57*a* to 57*d* reaching just under the corresponding toner boxes 51 are each upwardly bended toward the bottom of corresponding toner boxes 51, respectively. Further, an insertion hole 57*i* is formed in an upper end of the channel. The leading blowing ends 53*a* to 56*a* (see FIG. 3) of the flexible tubes 53 to 56 are placed into the insertion holes 57*i* to face the bottoms of toner boxes (i.e., the object to be cooled), respectively.

As described above, the flexible tubes 53 to 56 each connect the air exit 52*a* of the cooling fan 52, which is to cool inside the housing 2, to corresponding toner boxes 51 within the housing 2, respectively. This makes it possible to connect the air exit 52*a* of cooling fan 52 to toner boxes 51 even if there is no space to provide ducts or the like between the air exit 52*a* and the toner boxes 51, since the flexible tubes 53 to 56 originated from the air exit 52*a* can flexibly follow narrow gaps existing within the housing 2 to reach toner boxes 51. The cool wind come out of the air exits 53*a* to 56*a* of the flexible tubes 53 to 56 flows along the bottom (i.e., the object to be cooled) of the toner boxes 51 as indicated by the arrow "a" in FIG. 6A. Thus, the cooling fan 52 can finally cool the toner boxes 51.

Also, the four toner boxes for full color imaging are separately cooled, respectively. This makes it possible to prevent the toner within each color box form losing its fluidity due to the heat generated by stirring the toner, which results in a successful formation of a desired full color image.

Further, the flexible tubes 53 to 56 fit into the channels 57*a* to 57*d* provided on the side frame wall 57*p* of the main frame 57, respectively. Thus, the flexible tubes 53 to 56 are suitably guided. Further, the leading blowing ends 53*a* to 56*a* of the flexible tubes 53 to 56 are placed into the insertion holes 57*i* bored through the side frame wall 57*p*. Thus, the leading blowing ends 53*a* to 56*a* serving as air exits correctly face to the bottom of the toner boxes as the object to be cooled. Accordingly, the flexible tubes 53 to 56 can be easily mounted.

The foregoing embodiment is directed to cool the four toner boxes 51 for full color image formation. However, the present invention is applicable to an image forming apparatus provided with a single toner box for mono color, such as black. Even in such a case, the single toner box can be successfully cooled with the toner prevented from losing its fluidity due to the heat generated by stirring the toner, which results in a successful formation of a desired mono color image.

In the foregoing embodiment, an object to be cooled is the toner box 51 of the image forming apparatus. However, it is needless to say that the present invention is applicable to cool other object, such as a photoconductive drum, a central processing unit, a polygon driver, and a fixing unit.

As described above, in the foregoing embodiment, the image forming apparatus comprises: a housing; an object to be cooled, the object being of a nature to generate heat and provided inside the housing; an air current generator which generates air current to ventilate the housing; and an air introducing member provided between the air current generator and the object for cooling the object, the air introducing member being made of flexible material.

The above construction makes it possible to successfully cool the object even if there is no space to provide ducts or the like between the air current generator and the object to be cooled.

According to the embodiment, the object to be cooled includes a toner container provided in the housing. In this case, the toner box can be successfully cooled. The toner therein can be prevented from losing its fluidity due to the heat generated by stirring the toner, which results in a successful formation of a desired image.

According to the embodiment, further, the object to be cooled includes a plurality of toner containers each containing a toner of a different color from another for color development. The air introducing member includes a plurality of flexible tubes each connecting the air current generator to the corresponding toner containers, respectively. In this case, the plurality of toner boxes are separately cooled, respectively, which results in a successful formation of a desired color image.

According to the embodiment, the flexible tubes each have an opening in the leading end through which the air current flows. These openings are so connected to the toner containers that the air current through the openings lead to the air current flowing through spaces within the inherent structure of the toner containers, respectively. In other words, the openings are located without deeply inserted into the inherent structure of the toner containers, respectively. This construction is advantageous in cooling the object even if there is no space to provide ducts or the like between the air current generator and the object to be cooled.

In the embodiment, the plurality of toner containers include a toner container for containing black toner, a toner container for containing cyan toner, a toner container for containing yellow toner and a toner container for containing magenta toner for full color development, respectively. Each of the toner boxes is separately cooled. Accordingly, it is advantageous in successfully forming a desired full color image with the four colors of toners.

In the embodiment, further, the image forming apparatus further comprises a guide for fixedly guiding the air introducing member along a predetermined route. Therefore, the air introducing member is firmly located along the predetermined route in spite of the nature of the air introducing member incapable of keeping any rigid form by itself. In more detail, the guide is open to receive the air introducing member, the guide having no function of leading the air by itself. Such a guide is simple in structure and small in size, which makes it possible to easily locate the guide even in a narrow space with no space to provide ducts or the like.

According to the embodiment, further, the air introducing member has an air blowing leading end through which the air current flows. The apparatus is further provided with a retaining portion for fixedly retaining the leading end toward the object. Thus, the leading end of the air introducing member can be firmly directed to the object to be cooled in spite of the nature of air introducing member incapable of keeping any rigid form by itself.

According to the embodiment, the object includes a plurality of portions to be cooled by a single air current generator. The air introducing member includes a plurality of flexible tubes each introducing the air current generated by the single air current generator to the plurality of portions, respectively. Such cooling of a plurality of portions by a common single air current generator with the air current led by the plurality of flexible tubes, respectively, makes it possible to successfully cool the plurality of portions at any desired locations even if there is no space to provide ducts or the like between the common air current generator and the plurality of portions, respectively.

According to the embodiment, the image forming apparatus is provided with: a housing; an object to be cooled, the object being of a nature to generate heat and provided inside the housing; an air current generator which generates air current to ventilate the housing; an air introducing member provided between the air current generator and the object to thereby cool the object, the air introducing member being airtight and made of flexible material; and a guide for rigidly guiding the air introducing member along a predetermined route, the guide having no function of introducing the air by itself.

In other words, the airtight air introducing member made of flexible material bears the function of efficiently introducing air, while the guide bears the function of rigidly guiding the air introducing member along a predetermined route. This structure results in a simple and compact construction of efficiently introducing air between the air current generator and the object to be cooled even if there is no space to provide ducts or the like between the air current generator and the object. Also, this is advantageous to easily assemble the apparatus with the cooling structure under the condition of such an insufficient space only allowed.

This application is based on patent application No. 2005-191900 filed in Japan, the contents of which are hereby incorporated by references.

Although the present invention has been fully described by way of the embodiment with reference to the accompanying drawings, it is to be understood that various changes and modifications will be apparent to those skilled in the art. Therefore, unless otherwise such change and modifications depart from the scope or spirit of the invention, they should be construed as being included therein.

What is claimed is:

1. An image forming apparatus comprising:

a housing;

an object having a nature to generate heat, the object being provided inside the housing;

an air current generator mounted in a specified position of the housing for taking-in air from the outside of the housing; and a flexible tube for introducing the taken-in air to the object to thereby cool the object, the flexible tube having a tailing end for permitting the taken-in air to flow into the flexible tube from the air current generator, and a leading end for permitting the taken-in air to flow out to the object from the flexible tube; and at least one guide channel formed along a predetermined route extending to the object, the guide channel accommodating at least part of the flexible tube, wherein the housing includes a side wall with an outwardly facing surface, the guide channel being formed at least partly along the outwardly facing surface of the side wall.

2. The image forming apparatus according to claim 1 wherein the object includes a toner container provided in the housing.

3. The image forming apparatus according to claim 1 wherein the object includes a plurality of toner containers for color development containing toner of different colors, respectively, and a plurality of flexible tubes for the plurality of toner containers, respectively, and a plurality of guide channels are provided for accommodating the plurality of flexible tubes, respectively.

4. The image forming apparatus according to claim 3, wherein the plurality of toner containers includes a toner container for containing black toner, a toner container for containing cyan toner, a toner container for containing yellow toner, and a toner container for containing magenta toner for full color development, respectively.

5. The image forming apparatus according to claim 3, wherein the plurality of guides extend substantially parallel and adjacent to one another along at least parts of the respective guides.

6. The image forming apparatus according to claim 1 further comprising a retaining portion for fixedly retaining the leading end toward the object.

7. The image forming apparatus according to claim 1 wherein the air current generator includes a fan which generates air current into the housing.

8. The image forming apparatus according to claim 1, wherein the object includes a plurality of portions to be cooled, and a plurality of flexible tubes are provided for the plurality of portions, respectively, an a plurality of guide channels are provided for accommodating the plurality of flexible tubes, respectively.

9. The image forming apparatus according to claim 1, wherein the guide channel has an upstream end in proximity to the air current generator and a downstream end in proximity to the object having a nature to generate heat, the side wall being formed with at least one hole at the downstream end of the guide channel, the flexible tube extending from the air current generator, through the hole in the side wall and along the guide channel toward the downstream end thereof.

10. The image forming apparatus according to claim 9, wherein the side wall is substantially planar and the guide channel being defined by at least two spaced apart guide walls extending out from the side wall of the housing, the flexible tube being aligned at an angle to the substantially planar side wall at positions between the hole at the upstream end of the channel and the air current generator.

11. An image forming apparatus a housing;

an object having a nature to generate heat, the object being provided inside the housing;

an air current generator mounted in a specified position of the housing for taking-in air from the outside of the housing; and a flexible tube for introducing the taken-in air to the object to thereby cool the object, the flexible tube having a tailing end for permitting the taken-in air to flow into the flexible tube from the air current generator, and a leading end for permitting the taken-in air to flow out to the object from the flexible tube; and at least one guide channel formed along a predetermined route extending to the object, the guide channel accommodating at least part of the flexible tube, wherein a guide channel is elongated and non-linear, the guide channel having an open side extending along a length thereof for receiving the flexible tube.

12. An image forming apparatus a housing;

an object having a nature to generate heat, the object being provided inside the housing;

an air current generator mounted in a specified position of the housing for taking-in air from the outside of the housing; and a flexible tube for introducing the taken-in air to the object to thereby cool the object, the flexible tube having a tailing end for permitting the taken-in air to flow into the flexible tube from the air current generator, and a leading end for permitting the taken-in air to flow out to the object from the flexible tube; and at least one guide channel formed along a predetermined route extending to the object, the guide channel accommodating at least part of the flexible tube, wherein the tailing end and the leading end of the flexible tube extend beyond opposite ends of the guide channel.

13. An image forming apparatus comprising:

a housing with a wall having a first surface facing inwardly on the housing and a second surface facing outwardly on the housing;

a plurality of objects each of which has a nature to generate heat, the objects being provided inside the housing and at least partly inwardly of the first surface of the wall of the housing;

an air current generator mounted in a specified position of the housing for taking in air from outside of the housing, the air current generator being spaced from the objects;

a plurality of guide channels formed along the second surface of the wall of the housing, each of the guide channels having an upstream end in proximity to the air current generator and a downstream end in proximity to the respective objects, each of the guide channels having an open side facing outwardly from the second surface of the wall; and a plurality of flexible tubes having intermediate portions disposed respectively in the guide channels, each of the flexible tubes having an upstream end communicating with the air current generator and a downstream end communicating with the respective objects, wherein the flexible tubes accommodate a flow of cooling air from the air current generator to the respective objects.

14. The image forming apparatus according to claim 13, wherein the wall is formed with a plurality of holes at the upstream ends of the respective guide channels, upstream ends of the flexible tubes passing through the holes in the wall and extending non-linearly from the wall to the air current generator.

15. The image forming apparatus according to claim 14, wherein the guide channels extend substantially parallel to a common plane.

16. The image forming apparatus according to claim 15, wherein the guide channels are non-linear.

* * * * *